US007250568B1

(12) United States Patent
Dow et al.

(10) Patent No.: US 7,250,568 B1
(45) Date of Patent: Jul. 31, 2007

(54) UNDERWATER VEHICLE DECELERATION AND POSITIVE BUOYANCY ASSEMBLY

(75) Inventors: Eric G. Dow, Barrington, RI (US); James D. Hrubes, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/484,147

(22) Filed: Jun. 30, 2006

(51) Int. Cl.
*F42B 19/00* (2006.01)

(52) U.S. Cl. ..... 114/20.1; 114/54

(58) Field of Classification Search ..... None
See application file for complete search history.

(56) References Cited

U.S. PATENT DOCUMENTS 1,998,805 A 4/1935 Driggs
3,047,259 A * 7/1962 Tatnall et al. ..... 114/20.1
3,706,294 A 12/1972 Radford
4,271,552 A 6/1981 Sandler
4,832,288 A 5/1989 Kendall et al.

* cited by examiner

*Primary Examiner*—Lars A. Olson
(74) *Attorney, Agent, or Firm*—James M. Kasischke; Michael P. Stanley; Jean-Paul A. Nasser

(57) ABSTRACT

An assembly for vehicle deceleration and buoyancy comprises a pair of doors enclosing flotation bags inflatable for buoyant recovery of the torpedo. In operation, the doors are controllably forced open to an initial angle off a longitudinal axis of the assembly to a fully-deployed position by hydrodynamic forces of the movement of the vehicle. From the doors blocking the hydrodynamic forces, the vehicle decelerates. The hydrodynamic braking action of the doors reduces the time required to reach terminal velocity, thus reducing the depth the vehicle sinks and enabling recovery with less gas required for inflation.

19 Claims, 19 Drawing Sheets

UNDERWATER VEHICLE DECELERATION AND POSITIVE BUOYANCY ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to describe a vehicle recovery assembly for underwater vehicles which operate under negatively buoyant conditions.

(2) Description of the Prior Art

A variety of recovery systems for underwater vehicles have been in operation since submersibles were first conceived and operated. More recently, the Navy has operated vehicles employing recovery systems designed to bring negatively ballasted vehicles to the surface upon conclusion of vehicle operations.

As indicated by the references that follow, present recovery systems rely on inflating bags (attached to the vehicle) with lower density gas or liquid, relative to seawater. The inflated bags provide sufficient positive buoyancy to lift the vehicle to the surface. The low density gas or liquid, can be stored internal to the vehicle at high density, where upon a command the fluid expands to a low density state into the recovery floats external to the vehicle.

The principle of buoyant bag recovery is straightforward, although complications arise for vehicles operating at speeds greater than 5 knots. Complications arise due to the hydrodynamic loading, which will occur when the buoyancy floats expand into the hydrodynamic flow past the vehicle. Under these circumstances, the forces are sufficient to damage the recovery bags, thus necessitating the use of exotic materials of construction for the bag. The materials are typically expensive, all but negating the possibility of having an affordable recovery system.

Furthermore, in order to retrieve the undersea vehicle after recovery from the surface water and subsequently prepare the vehicle for another operation, the entire recovery assembly must be replaced from within the vehicle, requiring excessive disassembly of the vehicle, another undesirable cost driver.

In Radford (U.S. Pat. No. 3,706,294), a recovery assembly conforming to the outer contour of a torpedo is disclosed. Compressed gas inflates an annular member that operates as a buoyancy device. A similar configuration with similar limitations exists in Sandler (U.S. Pat. No. 4,271,552) where a torpedo recovery assembly having an inflatable annular sleeve 28 is used to slow the torpedo and raise the torpedo to the water's surface.

In Driggs (U.S. Pat. No. 1,998,805), a torpedo recovery assembly is disclosed. In the cited reference, an inflatable bag 52 is pressurized when the carrying torpedo decelerates and the torpedo begins to sink in an undersea environment. The increased pressure at increased depths acts upon a diaphragm to allow air to inflate the bag 52 thereby opening external doors 55 and 56 to a buoyant bag 16. At least one limitation on device of the Driggs reference is that the doors may further decelerate the torpedo but as a result of an initial deceleration. The doors do not act to decelerate the torpedo initially.

An improvement to the recovery systems described above would be an assembly that could decelerate a torpedo or undersea vehicles from velocities in excess of five knots to deploy a buoyant recovery device. The assembly should be a lower cost alternative to present buoyant recovery systems, whereby the concept is based on a simple design employing single components designed to perform multiple and different functions, thus reducing complexity, increasing reliability and reducing overall cost of operation. The assembly should allow a relatively straight forward recovery of the torpedo or underwater vehicle via surface ship or some other means other than submerged recovery.

SUMMARY OF THE INVENTION

It is a general purpose and object of the present invention to provide a recovery assembly for underwater vehicles, which operate under negatively buoyant conditions while transiting at velocities in excess of five knots.

To attain the object described, a vehicle deceleration and positive buoyancy assembly is disclosed, hereinafter referred to as the "assembly". The assembly may be positioned on a torpedo or on alternate undersea vehicles. The assembly comprises a pair of doors acting as hydraulic/pneumatic dampened hydrodynamic drag brakes with accompanying flotation bags used for buoyant recovery of the torpedo.

The doors (or systematically named hydrodynamic drag brakes—HDB) are designed such that the doors are controllably forced open to an initial door angle and subsequently extended to the fully deployed position by hydrodynamic forces on the doors. These hydrodynamic forces acting in the opposite direction of the movement of the torpedo, decelerate the torpedo.

For any given initial vehicle velocity, the magnitude of the forces on the door are controlled passively by a compression damper linked to a door hinge assembly. A slot of the door hinge assembly allows a piston rod of the compression damper to travel while the door opens to an initial angle off the longitudinal axis. The action of piston controls the force from the door as a function of the instantaneous door opening angle and subsequent hydrodynamic force counteracting the movement force of the torpedo.

The initial door angle to the fully extended position will dictate the load profile acting on the door, thus the deceleration rate of the torpedo. The initial door angle allows the hydrodynamic flow to "catch" a leading edge of the door. The catch action strongly influences an initial force condition and resulting opening rate of the door.

The vehicle deceleration is predominantly a function of vehicle velocity, vehicle projected area, vehicle surface area, vehicle mass and the fluid medium which the vehicle is traveling thru. As such the doors, as hydrodynamic drag brakes, focus on their projected area to influence vehicle deceleration.

The method of inflating the flotation bags is by compressed gas. As depth increases, ambient pressure increases linearly. As pressure increases, the resulting volume of the inflated flotation bag decreases linearly, thus more gas is required at deeper depths to achieve the same volume. In many cases, the additional gas may not be available due to space limitations, thus rendering the recovery assembly useless at these deeper depths. Therefore, the hydrodynamic braking action of the doors reduces the time required to reach terminal velocity, thus reducing the depth the vehicle (or torpedo) sinks, thus enabling recovery with less gas required.

When deceleration of the torpedo is needed, a controller, either remotely-operated or by use of a depth sensor, actuates a first solenoid valve. Once actuated, the first solenoid valve allows high pressure gas (typically nitrogen gas, $N_2$) from a sphere to provide a release action of latches. Once the latches are released, a bleed line to the surrounding ocean environment depressurizes the latches allowing the latches to retract—typically after recovery of the assembly.

The releasing action of the latches allows the doors to open to the preset initial angle. Almost instantaneously, the packed pressure of the flotation bags acts against breakaway webs to assist the latches in setting the initial angle. The doors are further opened by ensuing hydrodynamic forces of the movement of the vehicle.

A second solenoid valve actuates to allow high pressure gas to flow from the sphere to the flow control valve. The second solenoid valve actuates when the torpedo decelerates to a pre-determined speed.

The flow control valve controls mass flow of the high pressure gas through the valve and into the flotation bags by an internal variable orifice piston balancing depth pressure from the surrounding ocean environment against a calibrated spring. As gas flows through the flow control valve, the gas passes into the flotation bags inflating them to full capacity in a period of time, depending on depth.

When the flotation bags are fully inflated, gas flow is allowed to pass through two high flow relief valves, limiting the pressure of each of the flotation bags thus preventing over-inflation of the flotation bags as the assembly rises to the ocean surface for recovery.

Once the assembly and the torpedo are recovered, a bleed valve on each of the flotation bags, allows deflation of the flotation bags. Once each of the flotation bags is deflated, the bags can be set in the storage cavity, the doors can be re-latched, the gas sphere can be recharged, and the assembly can be re-used.

The assembly of the present invention presents a new method to recover a negatively buoyant underwater vehicle using hydrodynamic drag brakes to decelerate the undersea vehicle. Because of the compression damper and strength of the door hinges, the doors do not separate from the vehicle upon deployment. Other recovery systems jettison their doors, which can result in damage to the outer vehicle surface as well as add to the cost of replacement doors after every run.

The doors can be deployed at high vehicle speeds, allowing for rapid deployment of the flotation bags at low vehicle velocities. The low vehicle velocities translate into lesser hydrodynamic loads on the flotation bags than other systems thereby greatly decreasing the cost of the flotation bags.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE PREFERRED EMBODIMENT

Figure 1:
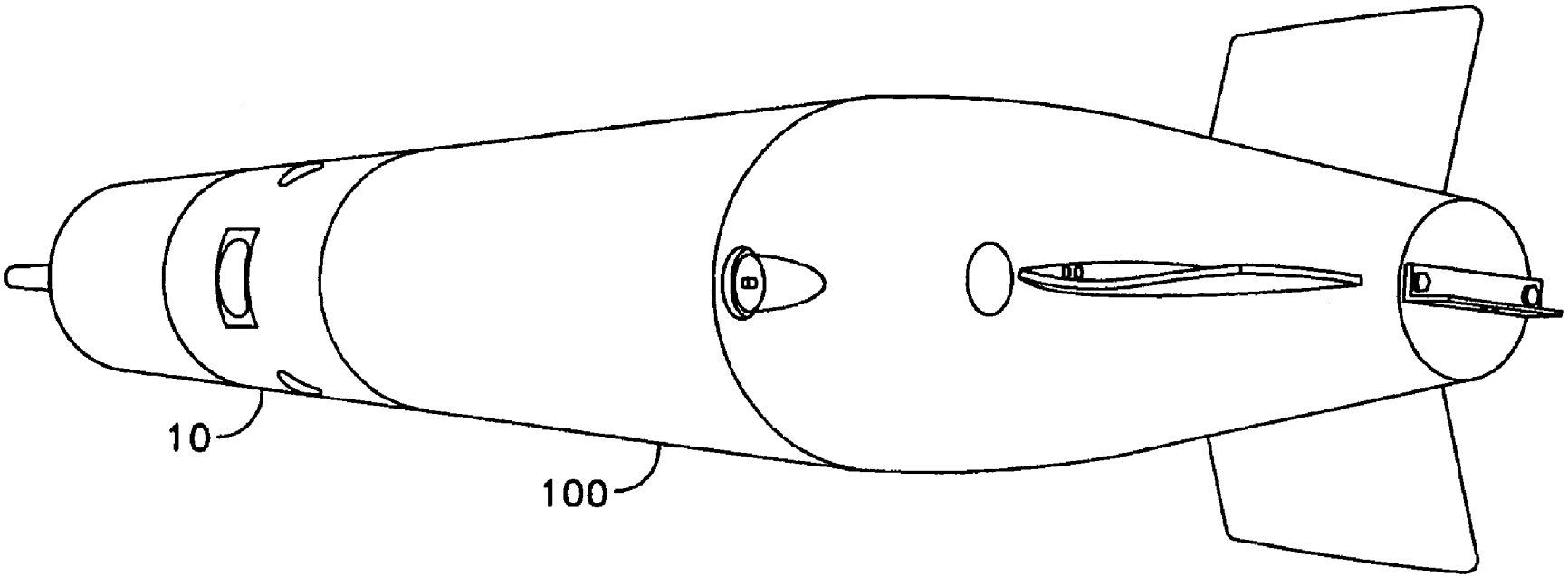
FIG. 1 depicts the vehicle deceleration and positive buoyancy assembly of the present invention positioned on a torpedo.
Figure 2:
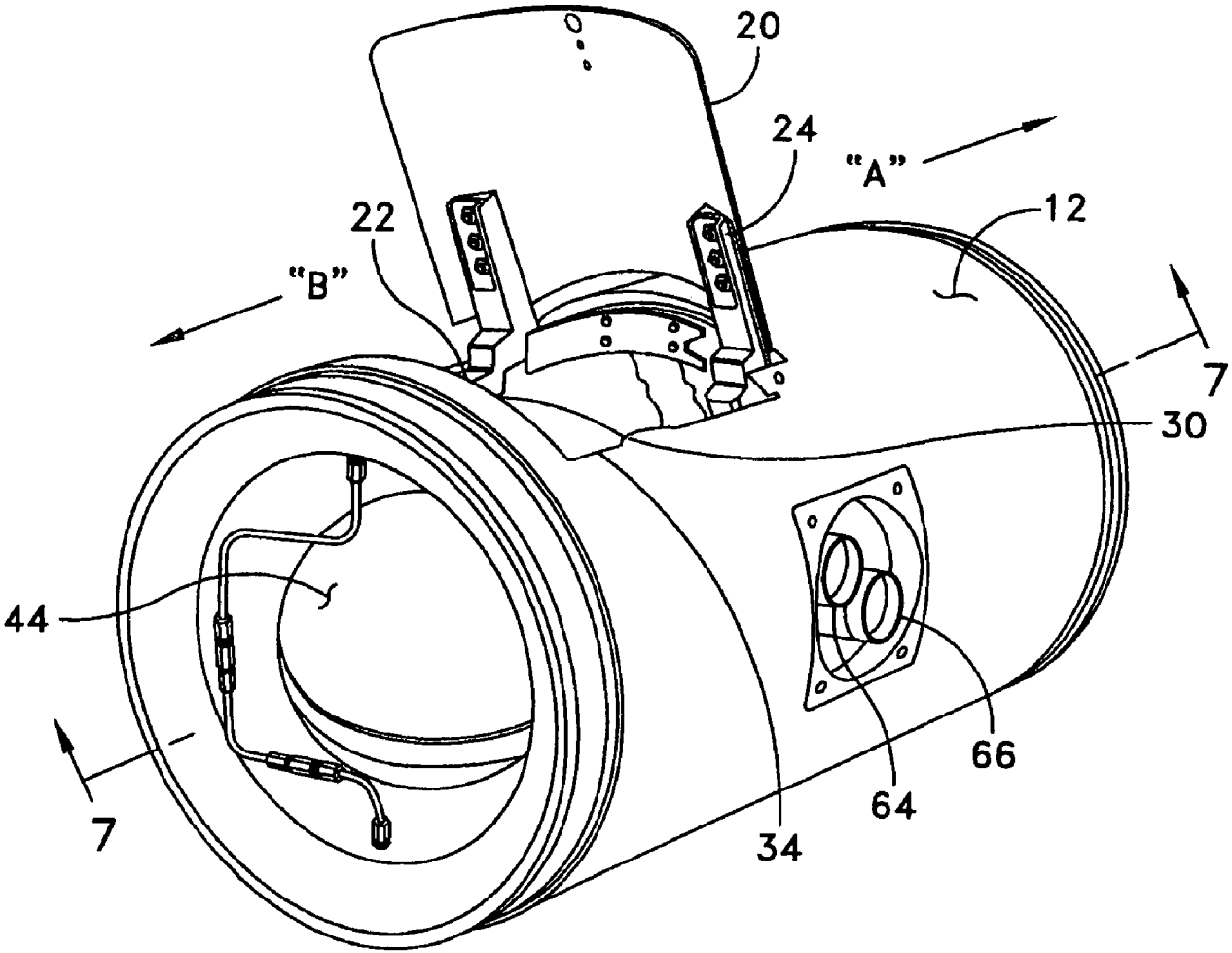
FIG. 2 depicts the assembly of the present invention with one of the decelerating doors deployed to a fully-extended position.
Figure 3:
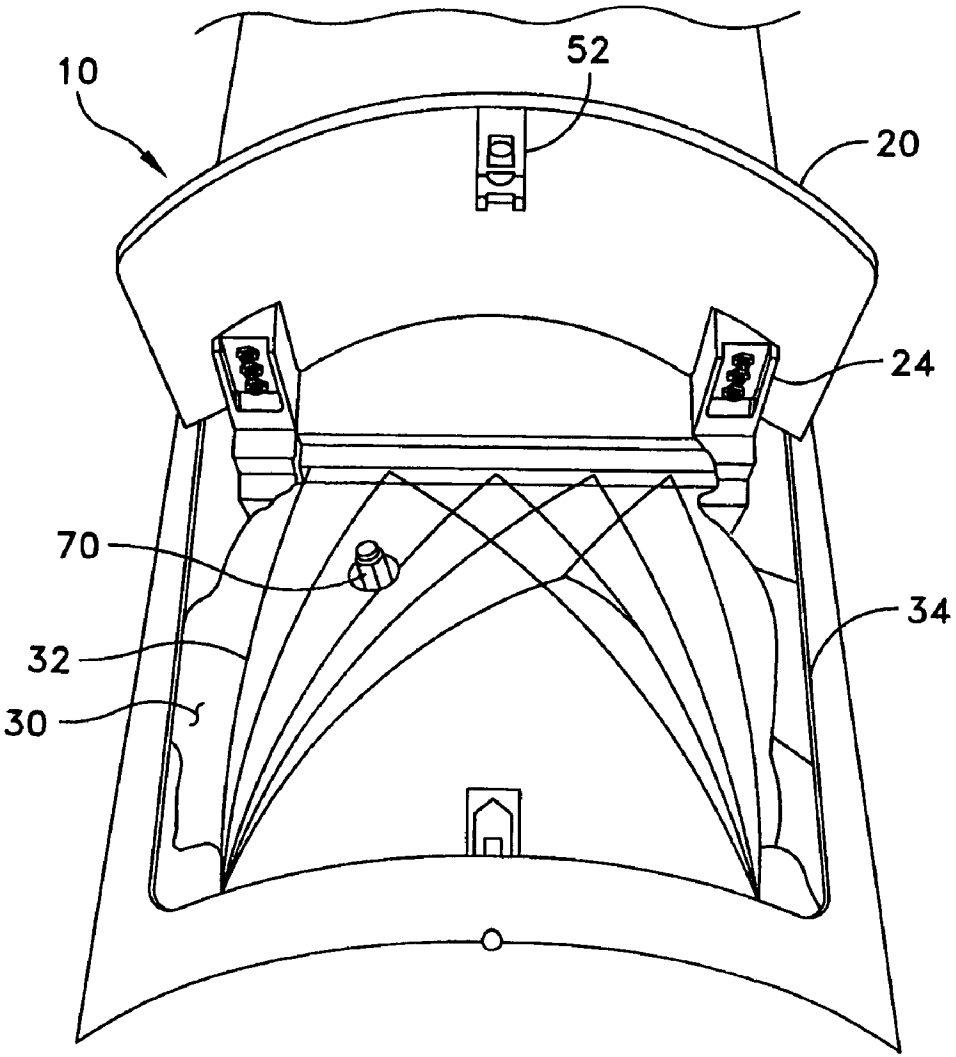
FIG. 3 depicts the assembly of the present invention with the position of the flotation bag interior to the assembly.
Figure 4:
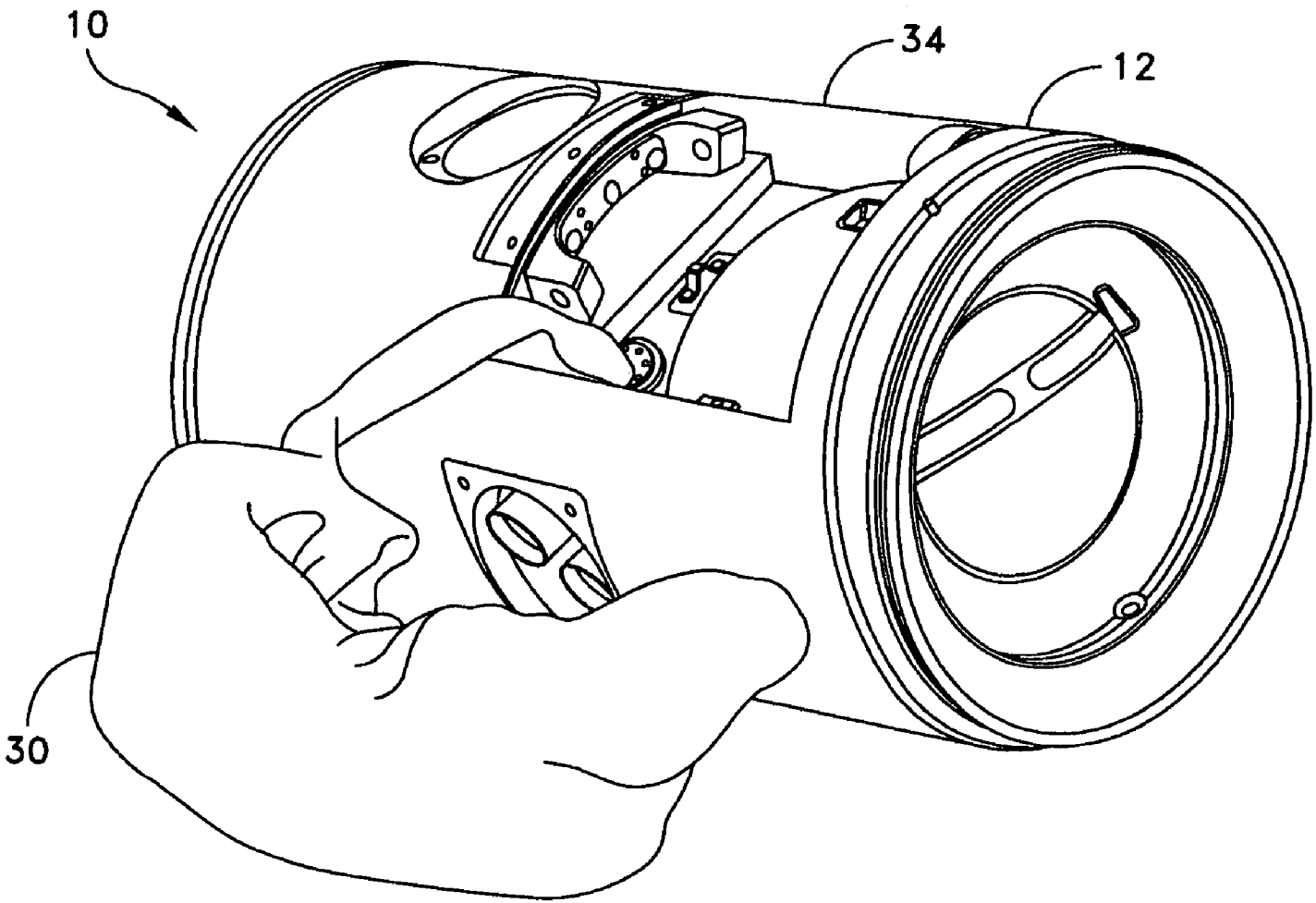
FIG. 4 depicts the assembly of the present invention with the position of the flotation bag exterior to the assembly.
Figure 5:
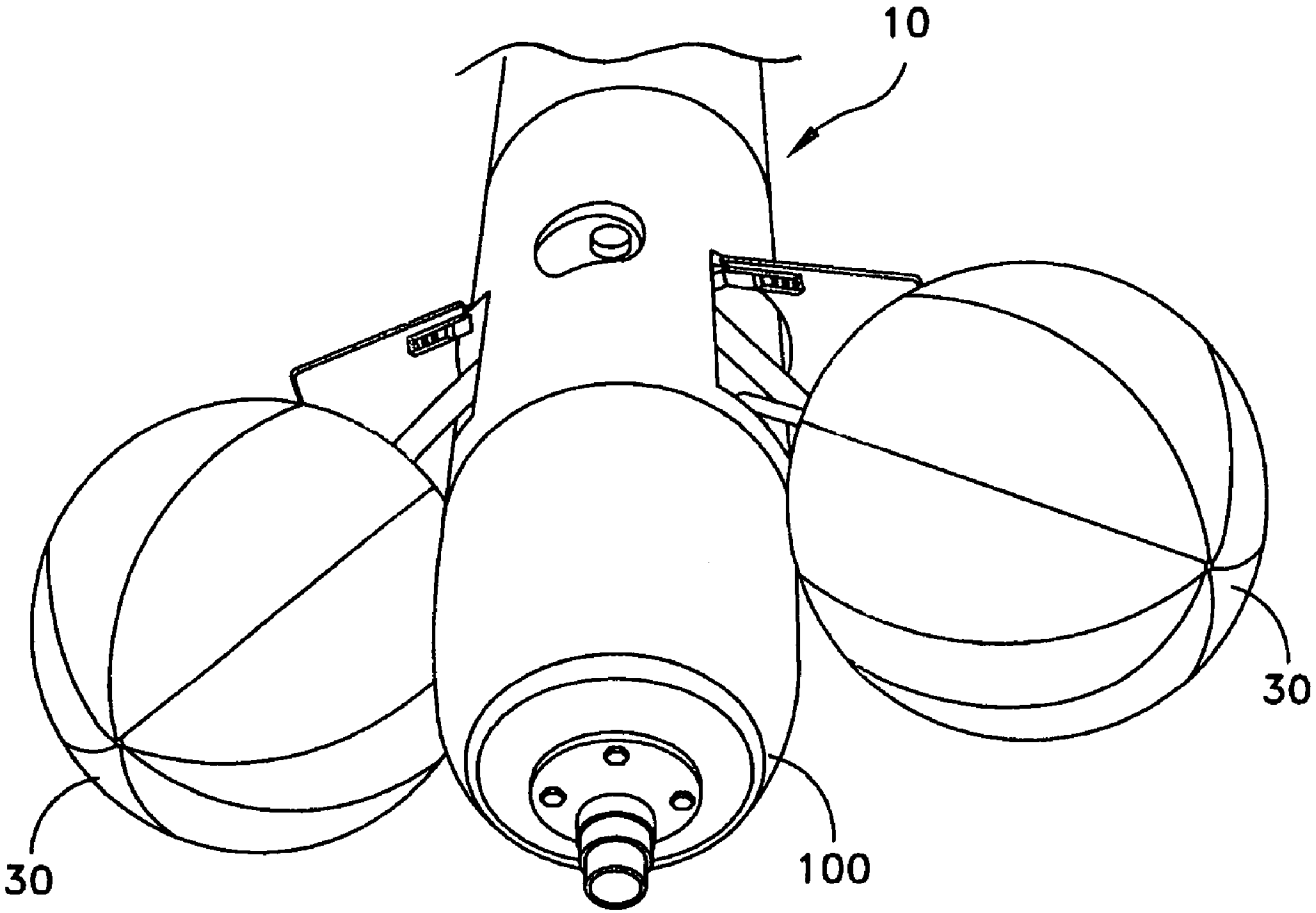
FIG. 5 depicts the assembly of the present invention with the flotation bags inflated for buoyancy and recovery.

The vehicle deceleration and positive buoyancy assembly 10 of the present invention, hereinafter referred to the "assembly" is depicted in FIG. 1 as attached to a torpedo 100. The assembly 10 may be positioned on alternate undersea vehicles by modifying the assembly with methods that would be known to those skilled in the art. The assembly 10, shown in FIG. 2, prior to attachment to the torpedo 100, generally comprises a pair of doors 20 acting as pneumatically dampened hydrodynamic drag brakes with accompanying flotation bags 30 used for buoyant recovery of the torpedo. See FIG. 3 for the flotation bag 30 interior to the assembly 10 and secured by a break-away web 32; FIG. 4 for the flotation bag exterior to the assembly; and FIG. 5 for the flotation bags inflated and exterior to the assembly.

When recessed to a surface 12, the doors 20 act as concealing sleeves of the recovery flotation bags 30 and a storage cavity 34. The doors 20 (or systematically named hydrodynamic drag brakes—HDB) are designed such that the doors are each actuated into the fully open position from the surface 12 of the assembly 10 as a result of the hydrodynamic forces acting on the doors. More specifically, as the doors 20 are controllably forced open to an initial door angle of approximately 17 degrees off a longitudinal axis 14 (shown in FIG. 6) to the fully deployed position of FIG. 2, hydrodynamic forces (as depicted by direction arrow "A") from the doors act in the opposite direction of the movement of the torpedo 100 (as depicted by direction arrow "B"), thus decelerating the torpedo.

Figure 7:
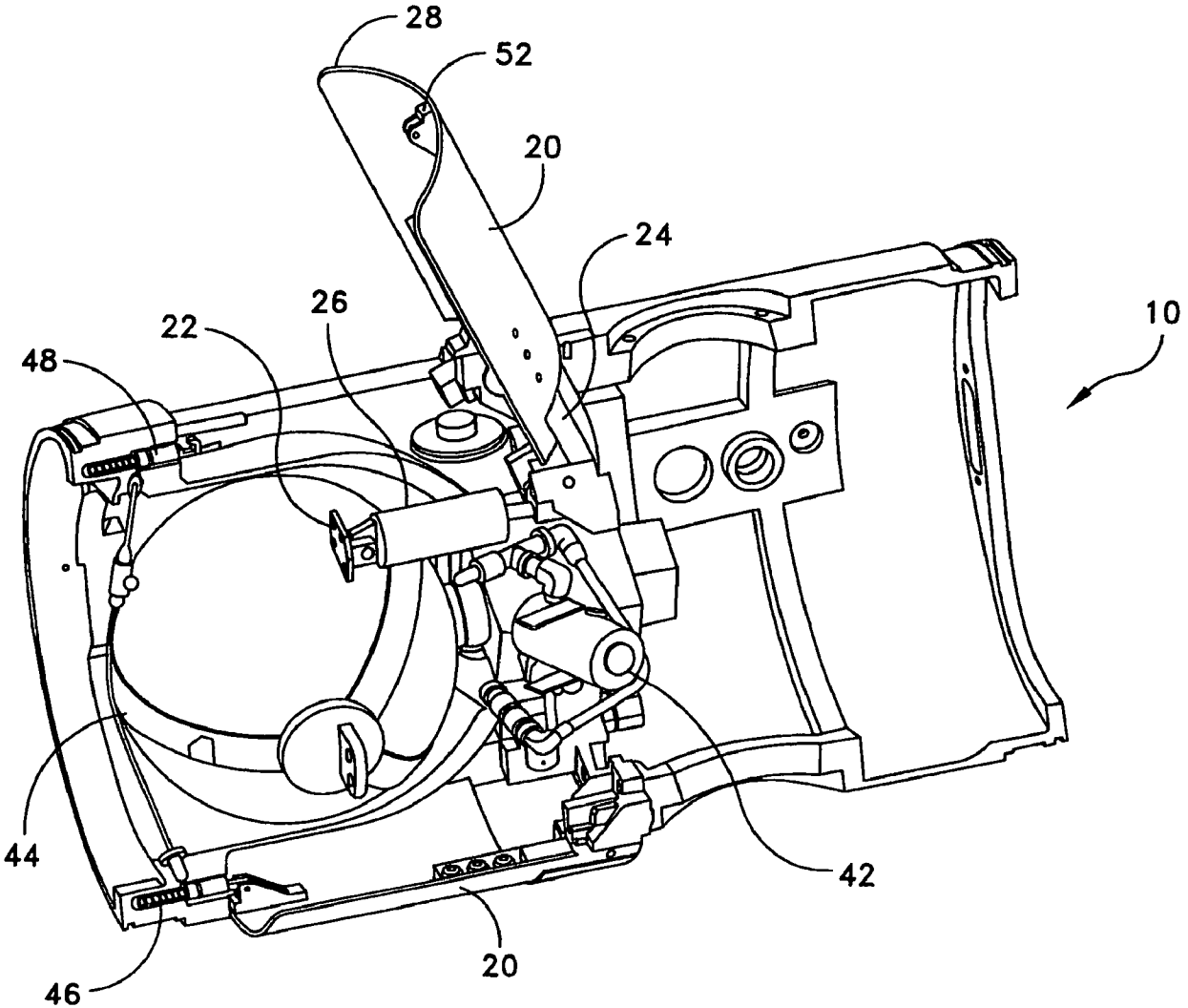
FIG. 7 depicts a cross-sectional view of the assembly of the present invention with the view taken from reference line 7-7 of FIG. 2 and the assembly rolled on a longitudinal axis of the assembly for a clearer depiction of the compression damper of the assembly.
Figure 8:
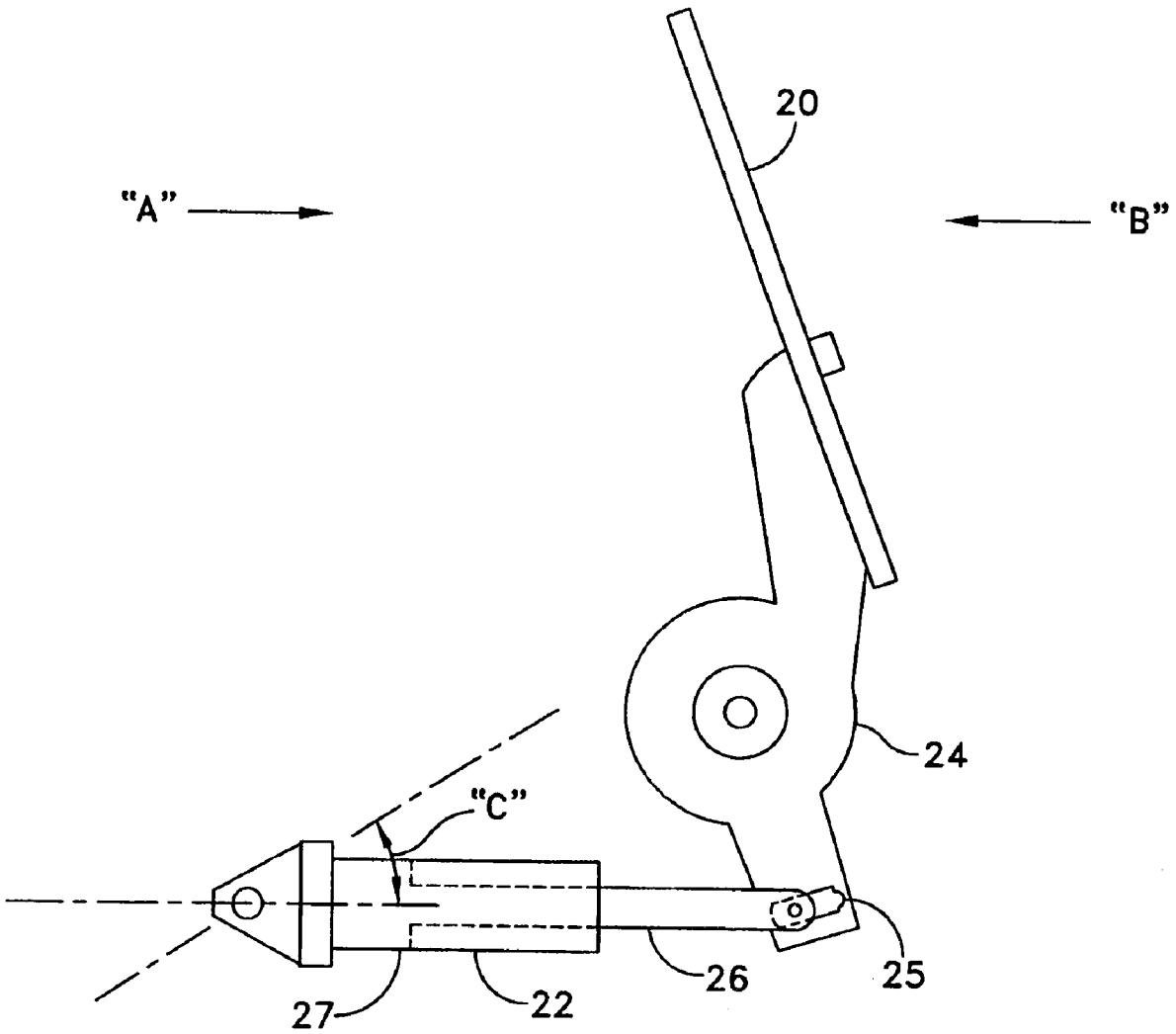
FIG. 8 depicts the compression damper of the assembly of the present invention.
Figure 9:
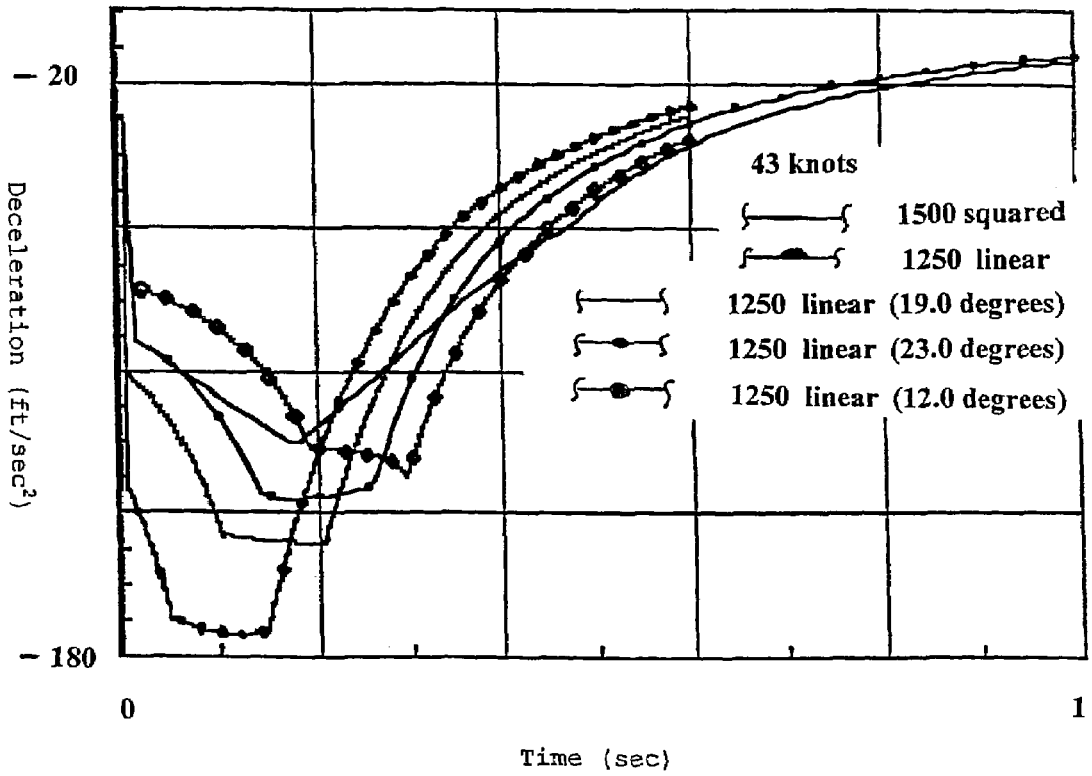
FIG. 9 is a graph showing the deceleration profile of the assembly of the present invention in use.
Figure 10:
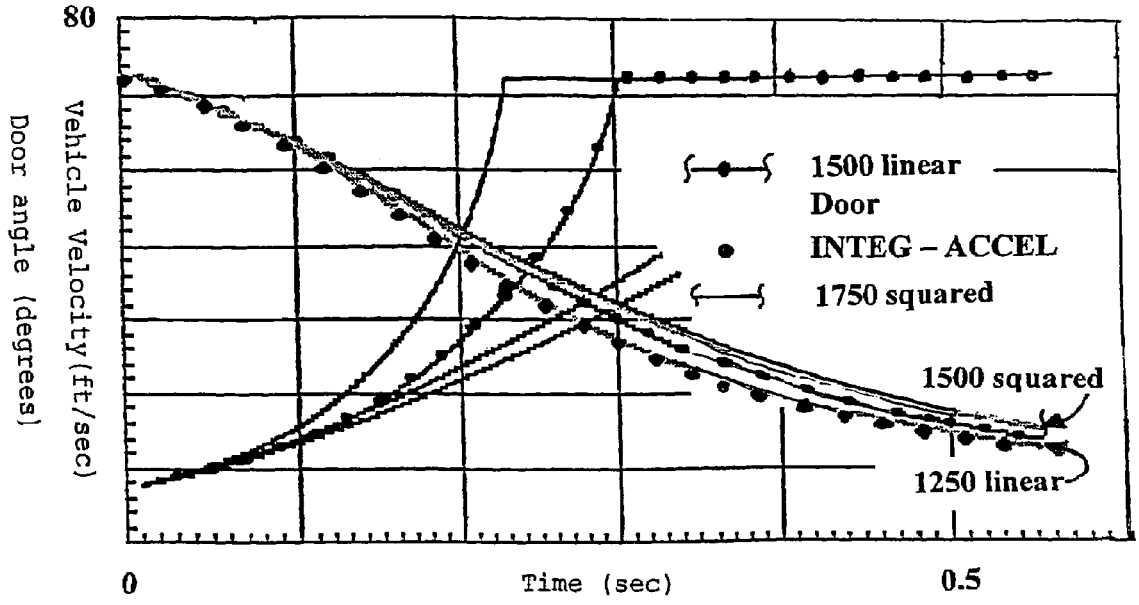
FIG. 10 is a graph showing the angle of the door of the assembly of the present invention overlaid onto the velocity of the assembly when attached to a moving torpedo.

For any given initial vehicle velocity, the magnitude of the forces on the door 20 are controlled passively by a compression damper 22 linked to a door hinge assembly 24 (See FIGS. 7 and 8). A slot 25 of the door hinge assembly 24 allows the door 20 to open to an initial angle of 17.7 degrees off the longitudinal axis 14 without resistance from the damper. At door angles greater than 17.7 degrees, the action of piston 27 controls the rate in which the door 20 opens and subsequent hydrodynamic force "A" counteracting the movement force "B" of the torpedo 100. FIG. 9 is a graph showing various deceleration profiles of the assembly 10 while FIG. 10 is a graph showing the angle of the door 20 overlaid onto the velocity of the assembly 10, for various damping characteristics.

The variations in the force characteristics, as determined by the deceleration profiles in FIG. 9, are strictly due to the damper characteristics of the door 20. Equation 1 defines the reaction force, F of the door 20, brought on by the damper 22 as follows:

$$F=kV_p^n \quad (1)$$

where k is the damping coefficient, $V_p$ is the velocity of the piston 27 of the damper 22 during its stroke and n is a dimensionless constant, which can vary depending on damper design initiatives.

For this application, dampers with coefficients ranging from k=800 to k=2000 together with linear dampers (n=1.0) and non-linear dampers (n=2.0) are depicted in FIGS. 9 and 10. For example, the curves in FIGS. 9 and 10 referenced as 1500 squared represent a non-linear (n=2) damper with a coefficient, k=1500.

Figure 6:
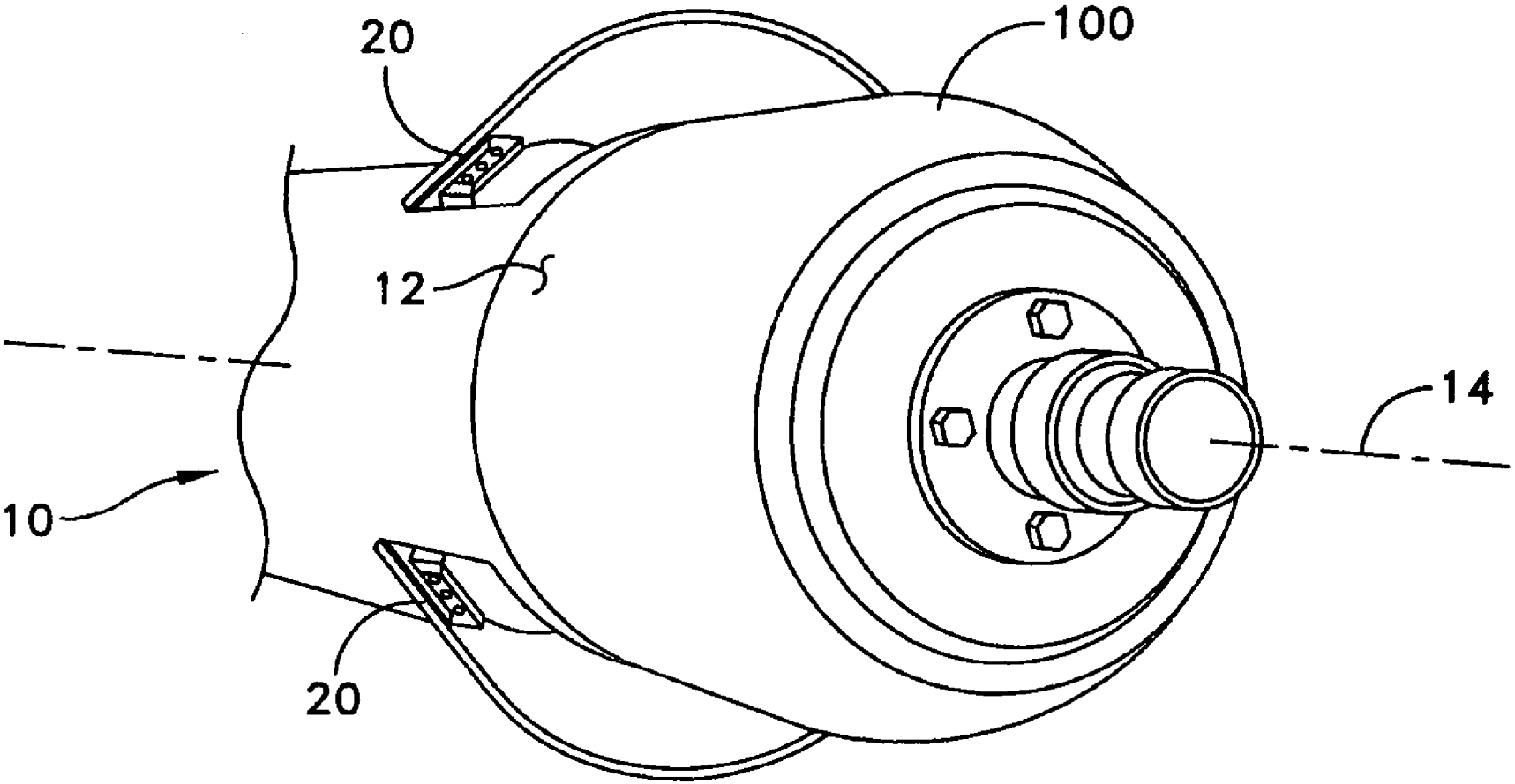
FIG. 6 depicts the assembly of the present invention with the decelerating doors deployed to an initial-extended position.
Figure 11:
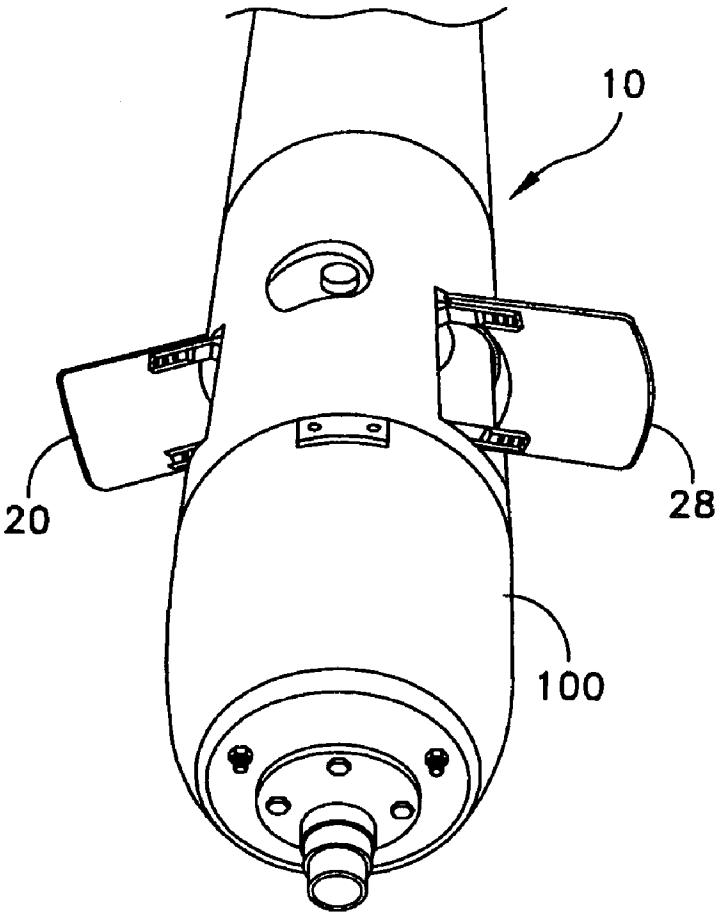
FIG. 11 depicts an alternate view of the assembly of the present invention with the decelerating doors deployed to a fully-extended position.

The initial door angle, shown in FIG. 6, to the fully-extended position in FIG. 11 will dictate the load profile acting on the door 20, thus the deceleration rate of the torpedo 100. The initial door angle allows the hydrodynamic flow to "catch" a leading edge 28 of the door 20. The catch action strongly influences an initial force condition and resulting opening rate of the door 20.

The dynamics of the torpedo 100 and expansively the vehicle deceleration are predominantly a function of vehicle velocity, vehicle projected area, vehicle surface area, vehicle mass and the fluid medium which the vehicle is traveling through. As such the doors 20, as hydrodynamic drag brakes, focus on their projected area to influence vehicle deceleration. The drag resulting from the doors 20 is:

$$F_d=CA\sin(\theta)V^2 \quad (2)$$

where $F_d$ is the resulting hydrodynamic drag force on the door, A is the projected area of the door, θ is the door angle and V is the velocity of the vehicle. The hydrodynamic drag force of the doors 20 is adaptive to the existing vehicle drag characteristics.

Figure 12:
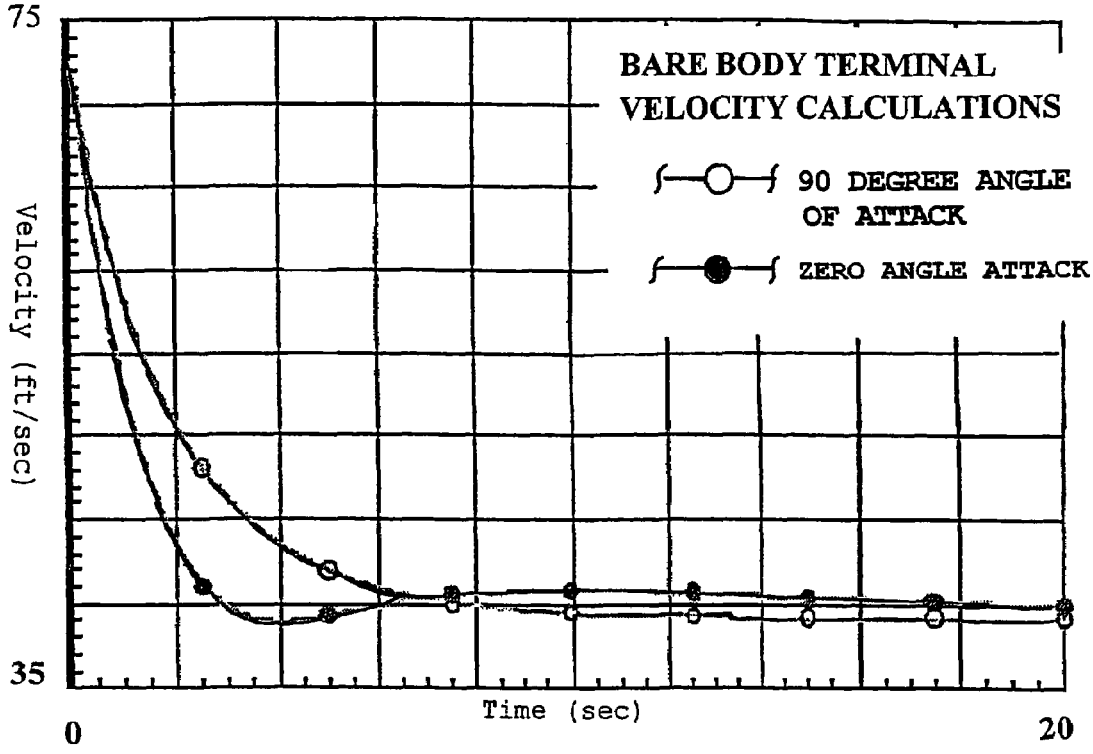
FIG. 12 depicts a graph showing typical deceleration profiles which would be exhibited by a negatively buoyant vehicle, without the doors deployed from the assembly of the present invention.
Figure 13:
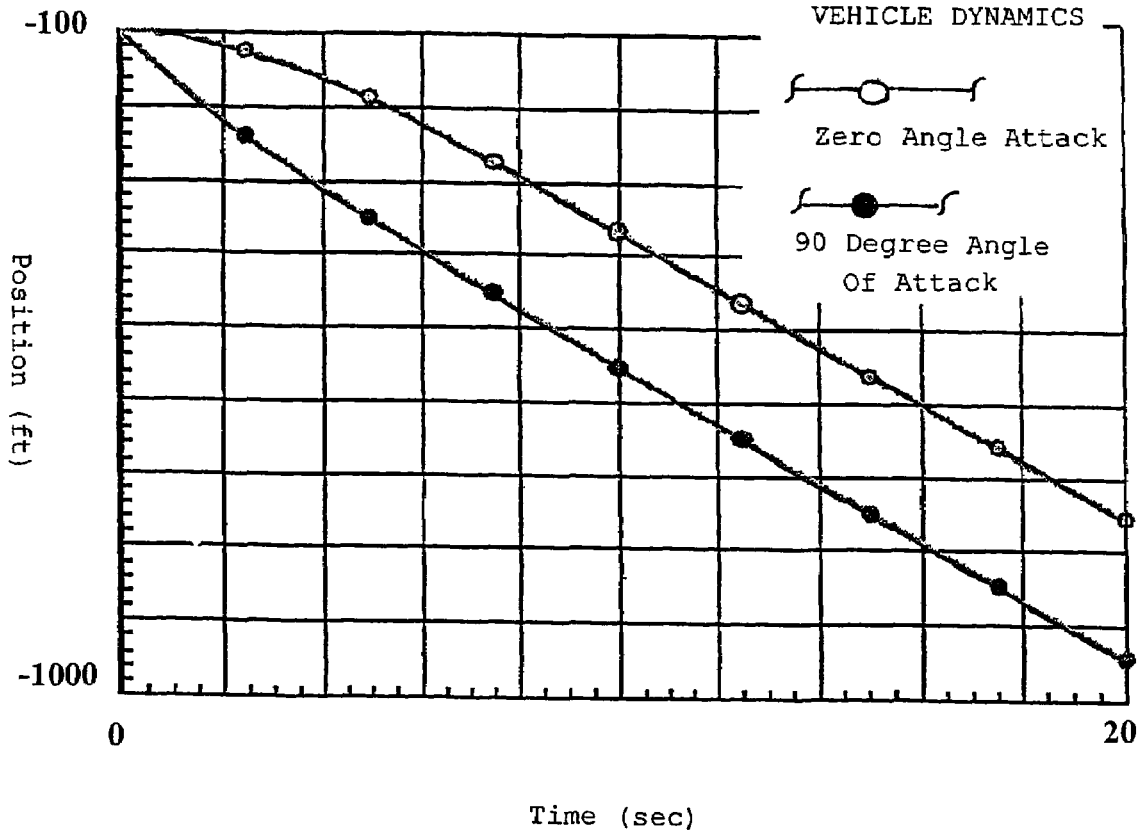
FIG. 13 depicts a graph showing a depth profile for a sinking negatively buoyant vehicle, without the doors deployed from the assembly of the present invention.

FIG. 12 shows typical deceleration profiles, which would be exhibited by a negatively buoyant vehicle, without the doors 20 deployed. During this time period, the negatively buoyant vehicle would sink excessively, as shown by the depth profile in FIG. 13. The significance of the increase in depth is great during the time transient to reach terminal velocity, which is minimum velocity for the case of no hydrodynamic doors deployed.

The method of inflating the flotation bags 30 is by compressed gas. As depth increases, ambient pressure increases linearly. As pressure increases, the resulting volume of the inflated flotation bag 30 decreases linearly, thus more gas is required at deeper depths to achieve the same volume (i.e., buoyancy) as defined by the relationship, $$V_{vol}=1/P*RT \quad (3)$$

where $V_{vOl}$ is the volume of the flotation bag 30, P is the ambient pressure acting on the flotation bag, R is the gas constant and T is the gas temperature in the flotation bag. In many cases, the additional gas may not be available due to space limitations, thus rendering the recovery assembly useless at these deeper depths. Therefore, the hydrodynamic braking action of the doors 20 reduces the time required to reach terminal velocity or a velocity suitable for flotation bag deployment, thus reducing the depth the vehicle (or torpedo 100) sinks, thus enabling recovery with less gas required (shown graphically in FIG. 14.

Figure 14:
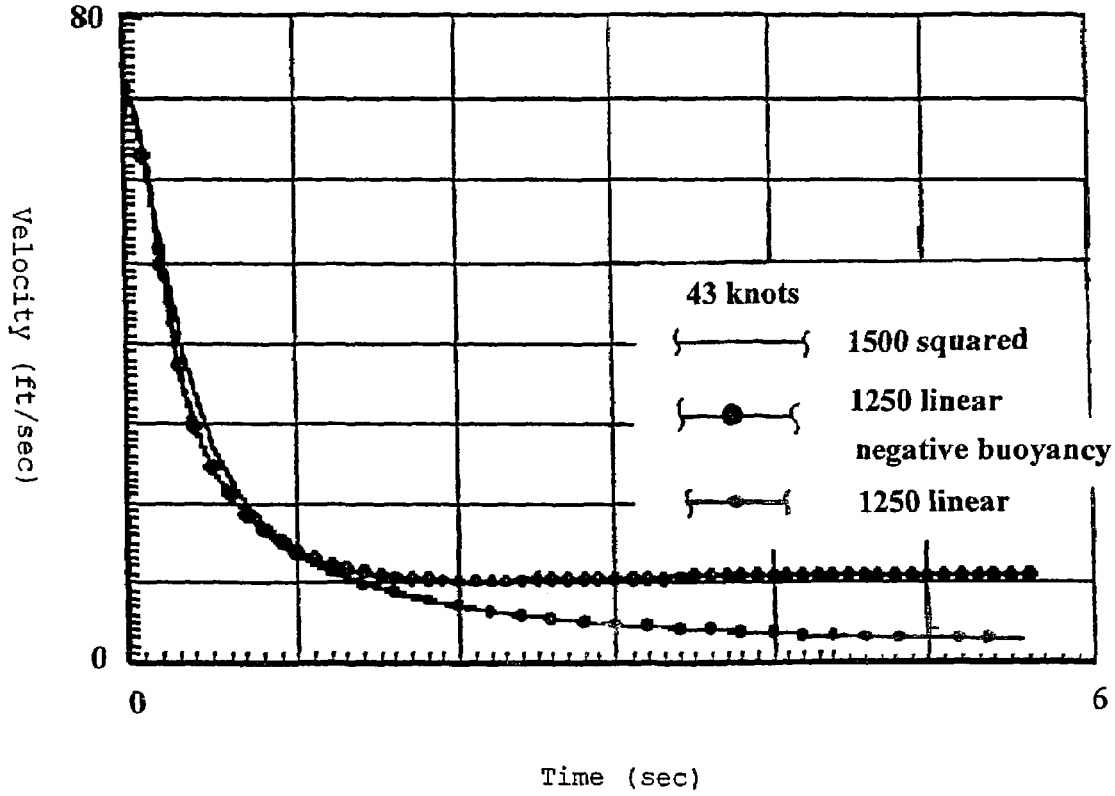
FIG. 14 depicts a graph showing a velocity profile for decelerating a vehicle with the doors deployed from the assembly of the present invention.

As is shown in FIG. 14, for a typical case of the torpedo 100 (shown) employing the doors 20 as hydrodynamic drag brakes, the velocity of 40 feet/second is reached in less than 0.3 seconds, a loss of less than 8 feet in depth. More importantly, the torpedo 100 is decelerated to a minimum velocity of 10 feet/second, significantly less than 40 feet/second minimum (terminal) velocity for when the doors 20 are not used as hydrodynamic drag brakes(see FIG. 12). The deceleration with the use of the assembly 10 occurs in less than 2 seconds, at which time the increase in depth would be less than 50 feet, a significant improvement over the 250 to 350 feet liability of having no drag brake doors. This lesser depth from the deceleration translates into greater available volume for the flotation bag 30, thus providing greater lifting capability in terms of more buoyancy available to lift heavier vehicles to the water surface.

Figure 15:
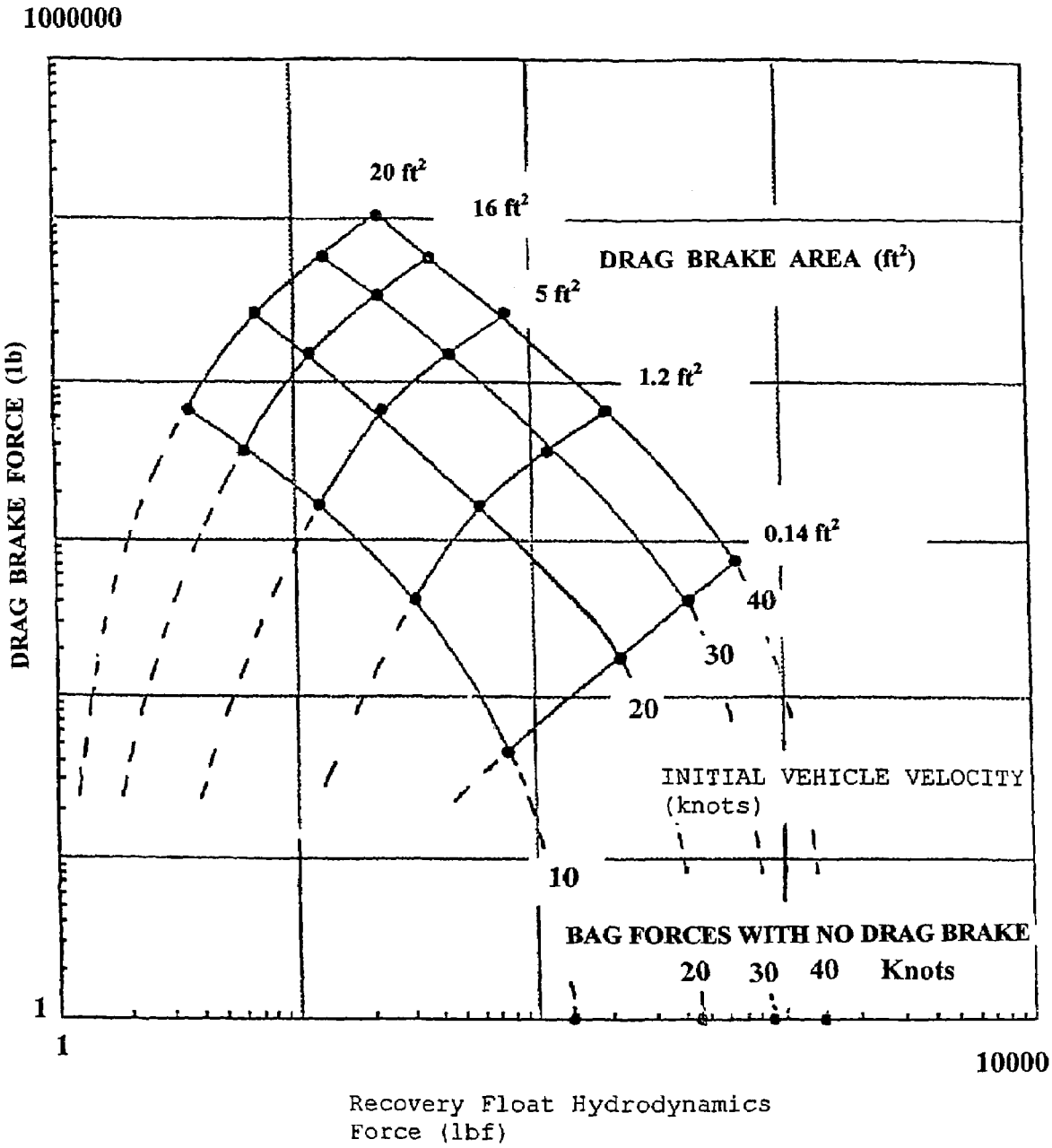
FIG. 15 depicts a graph showing hydrodynamic loading on a flotation bag of the assembly for various vehicle velocities.

The hydrodynamic loading on the flotation bag 30, having a given projected area into the free stream is proportional to the square of the vehicle velocity, thus the relevance of minimizing vehicle speed prior to deploying the floats into the free stream. As can be seen in FIG. 15, the hydrodynamic forces acting on the inflated flotation bags 30 can be substantial. The difference in expense between designing a flotation bag as a recovery float that can sustain a 20 pounds external load versus a flotation bag as recovery float that has to sustain a 1000 pounds external load can be very significant.

Figure 16:
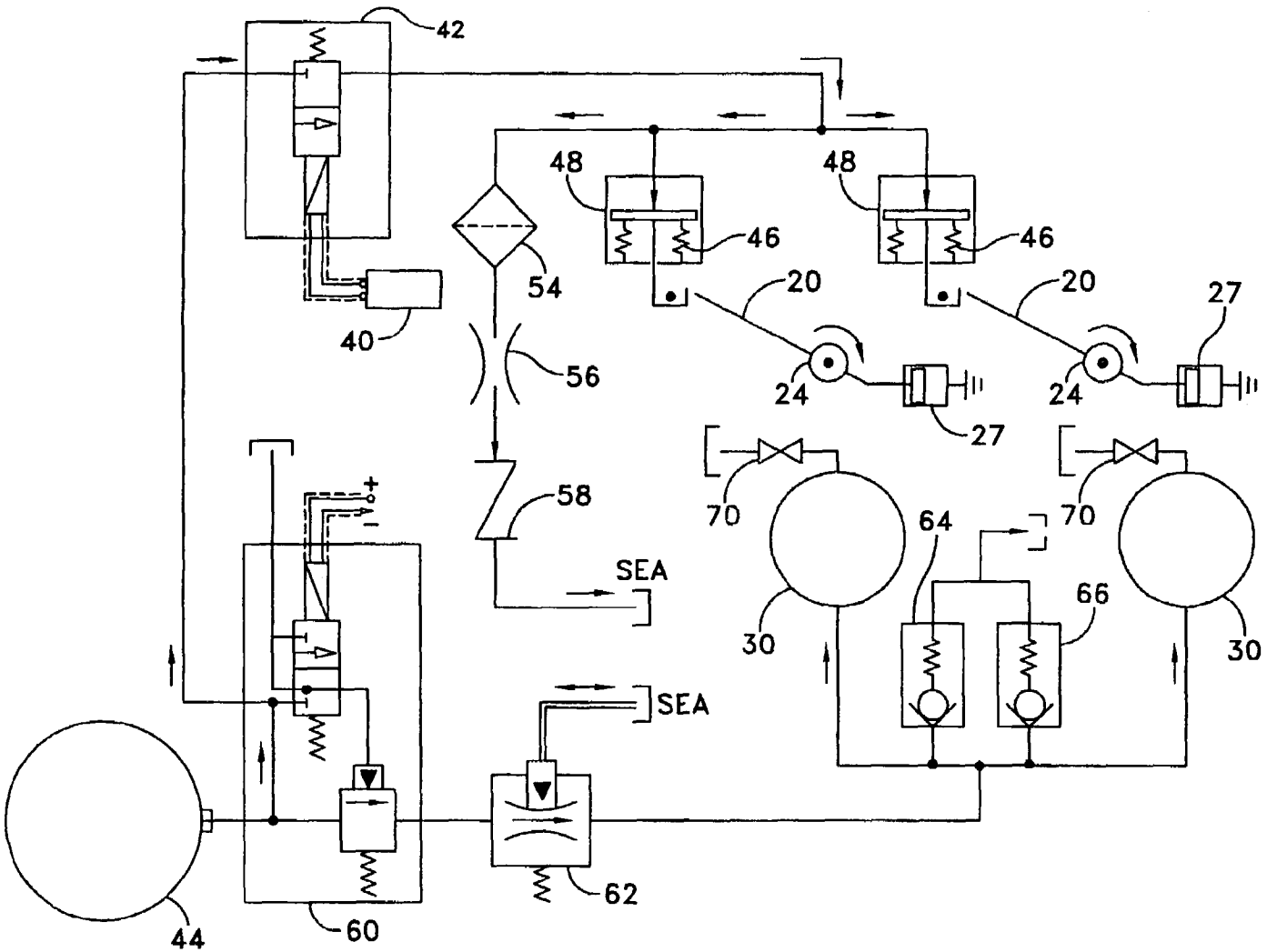
FIG. 16 is a schematic depicting the operation of the assembly of the present invention.
Figure 17:
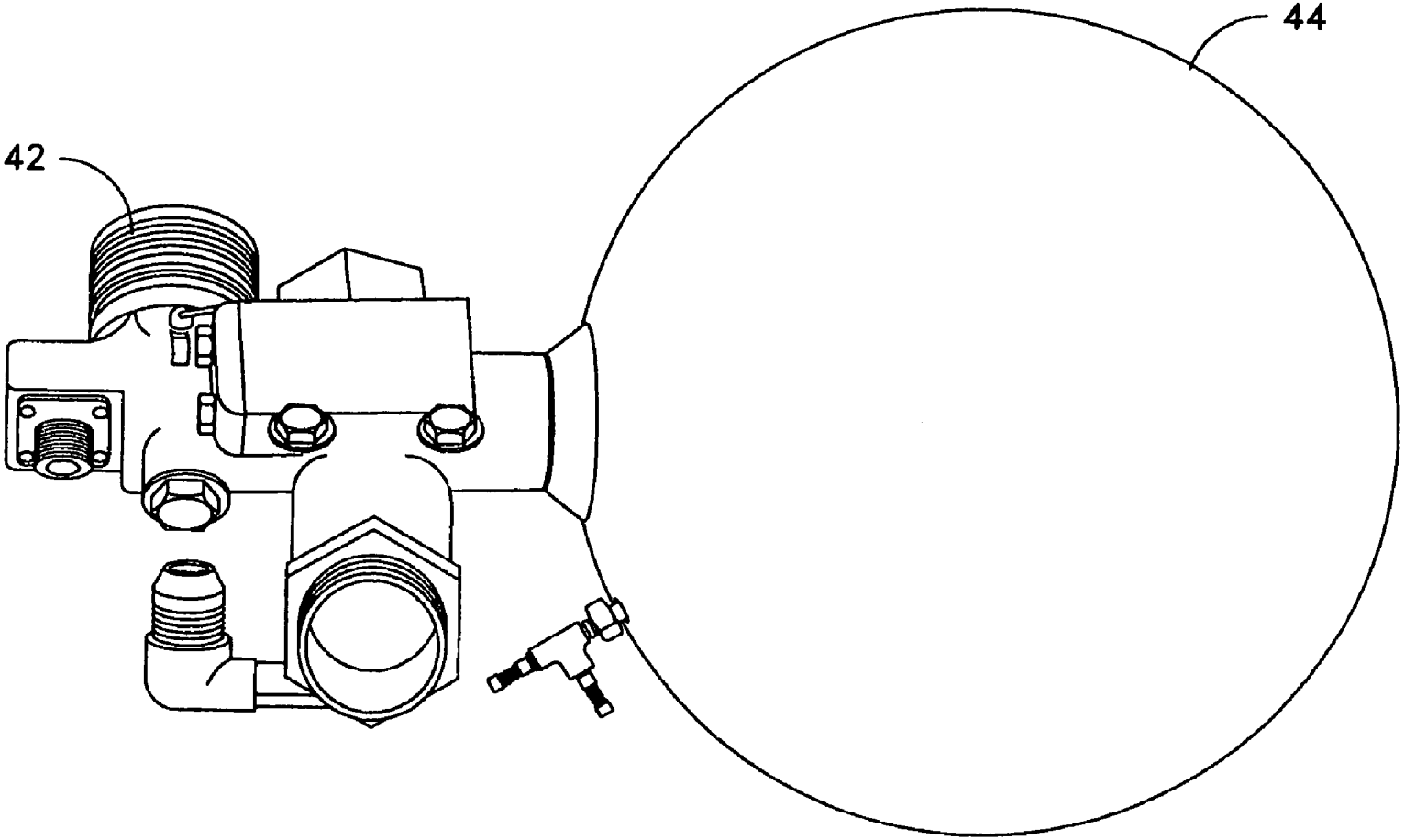
FIG. 17 depicts the compressed gas sphere of the assembly of the present invention.
Figure 18:
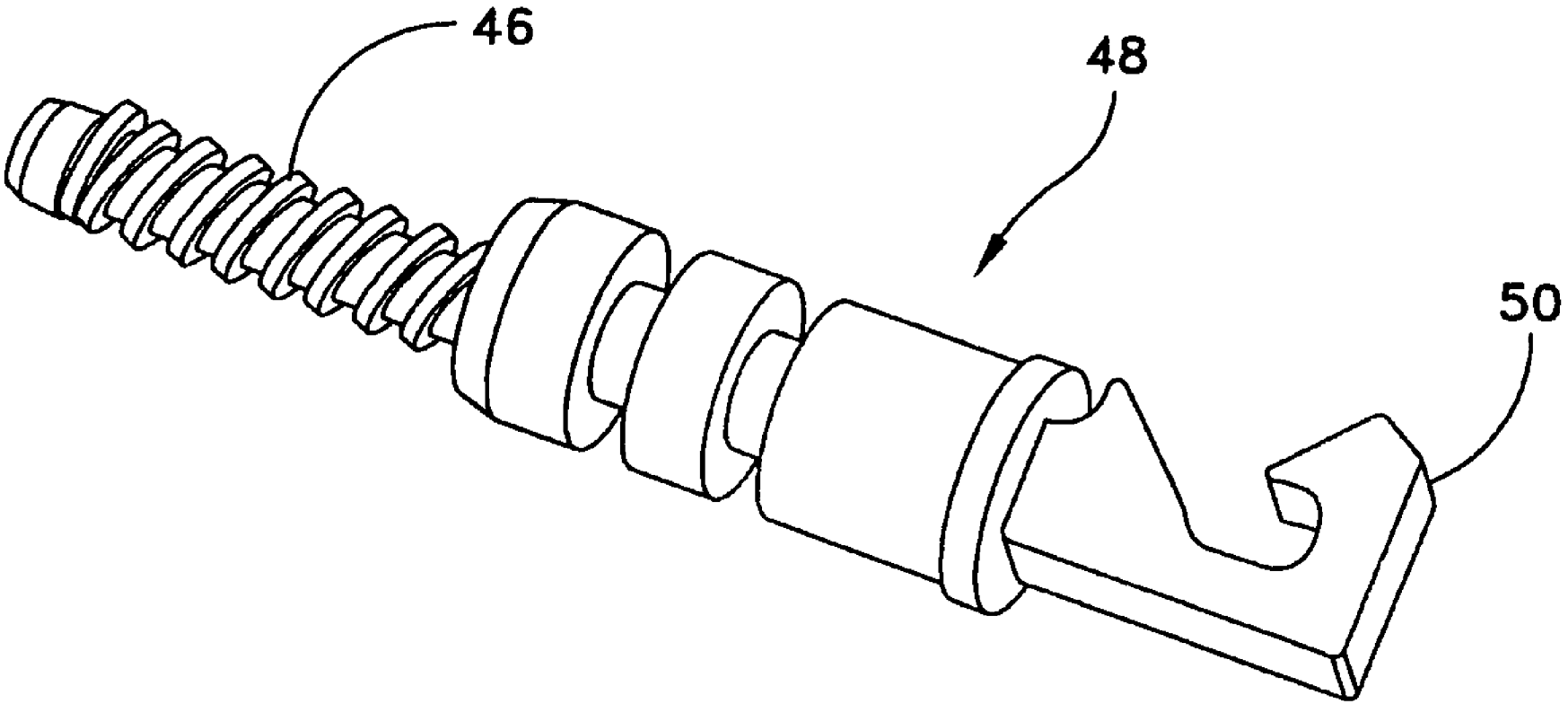
FIG. 18 depicts the latch of the assembly of the present invention.

Referring now to FIG. 16 as a schematic of how the assembly 10 operates when deceleration of the torpedo 100 is needed, a controller 40, either remotely-operated or by use of a depth sensor, actuates solenoid valve 42. Once actuated, the solenoid valve 42 (shown in a closed position) allows high pressure gas (typically nitrogen gas, $N_2$) from sphere 44 to pneumatically compress spring 46 to provide a release action of latches 48. A releasing action on the angled section of hook 50 pushes the door 20 open by acting on a mating hook 52 of the door (See FIG. 17 for the a detailed view of the sphere 44 and FIG. 18 for a detailed view of the of the latch 48). Once the latches 48 are released, a bleed line to the surrounding ocean environment, "SEA", depressurizes the latches allowing the springs 46 to expand and the hooks 50 to retract. The bleed line includes a micro-filter 54, venturi orifice 56 and check valve 58. The spring-loaded latches 48 may be substituted with any suitable latch mechanism, known to those skilled in the art.

The releasing action of the latches 48 allows the doors 20 to open to the preset initial angle of approximately 17.7 degrees with the assistance of the compression dampers 27 (as described above). Almost instantaneously, the packed pressure of the flotation bags 30 acts against the breakaway webs 32 to assist the latches 48 in setting the initial angle. The doors are further opened by ensuing hydrodynamic forces as previously described (shown as the direction arrow "A" in FIG. 2).

A solenoid valve 60 allows high pressure gas (typically nitrogen, $N_2$) to flow from the sphere 44 to a flow control valve 62. The solenoid valve 60 actuates when the torpedo 100 decelerates after use to a certain speed.

Figure 19:
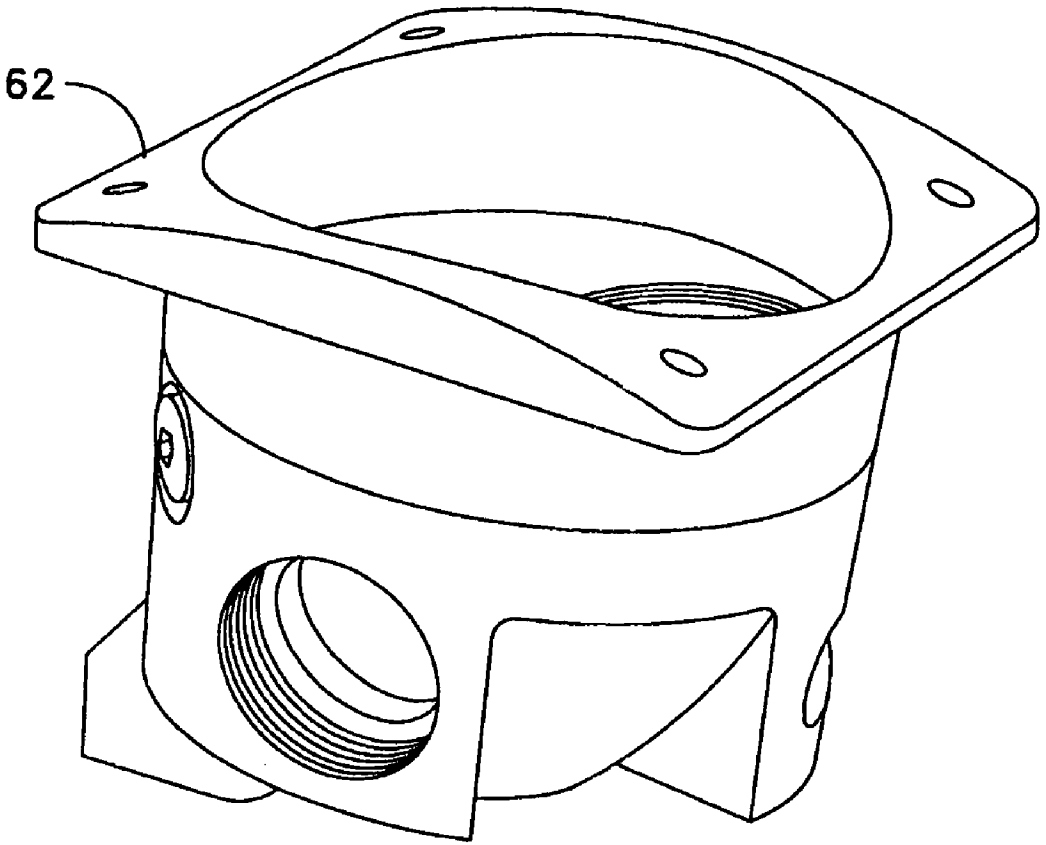
FIG. 19 depicts the flow control valve of the assembly of the present invention.

The flow control valve 62 controls mass flow through the valve and into the flotation bags 30 by an internal variable orifice piston balancing depth pressure from the surrounding ocean environment, "SEA", against a calibrated spring (See FIG. 19 for a view of the flow control valve). As gas flows through the flow control valve 62, the gas passes into the flotation bags 30 inflating them to full capacity in a predetermined period of time, depending on depth. When the flotation bags 30 are fully inflated, gas flow is allowed to pass through two high flow relief valves 64 and 66, limiting pressure of each of the flotation bags 30 to less than 14 psig over ambient pressure thus preventing over-inflation of the flotation bags as the assembly 10 rises to the ocean surface for recovery.

Once the assembly 10 and the torpedo 100 are recovered, a bleed valve 70 on each of the flotation bags 30, allows deflation of the flotation bags. Generally, once each of the flotation bags 30 is deflated, the bags can be set in the storage cavity 34, the doors 20 can be re-latched and the assembly 10 can be re-used.

The assembly 10 of the present invention presents a new method to recover a negatively buoyant underwater vehicle using hydrodynamic drag brakes to decelerate the torpedo 100 or undersea vehicle. No powered actuators are required for deployment other than the initial actuation of the latches 48 and the solenoid valve 60.

The deployment time of the doors 20 is also controllable by a single compression damper 22 linked to one of the doors. Because of the compression damper 22 and strength of the door hinges 24, the doors 20 do not detach from the torpedo 100 or vehicle upon deployment. Other recovery systems jettison their doors, which can result in damage to the outer vehicle surface as well as add to the cost of replacement doors after every run.

The doors 20 can be deployed at high vehicle speeds, allowing for rapid deployment of the flotation bags 30 at resultant vehicle velocities of less than 10 feet/second. These low vehicle velocities translates into hydrodynamic loads on the flotation bags 30 of less than 50 lbs; other systems would necessitate loads in excess of 2000 lbs, greatly increasing the cost of the flotation bags.

Alternatives to this assembly are either more expensive to operate due to the higher loads that the flotation bags or recovery floats must accommodate due to the lack of hydrodynamic drag doors or the alternatives do not have the ability to recover the vehicle rapidly from high initial vehicle speeds, thus requiring the vehicle to have inherently low operating speeds.

While the invention has been described in connection with what is considered to be the most practical and preferred embodiment, it should be understood that this invention is not to be limited to the disclosed embodiment, but on the contrary, is intended to cover various modifications and equivalent arrangements included within the spirit and scope of the appended claims.

What is claimed is:

1. A deceleration and positive buoyancy assembly for use with an undersea vehicle, said assembly comprising:

a hull section generally conforming in shape to a contour of the undersea vehicle upon which said hull section is positioned;

at least two cavities formed within said hull section, each of said cavities formed opposite to each other along a perimeter of said hull section;

a door mechanically secured to said hull section at each of said cavities, said door having a first and second end, said second end more proximate to a end of said hull section closer to a projecting end of the undersea vehicle than said first end of said door with each of said doors positioned to encompass said cavity coincident to an exterior surface of said hull section;

a hinge secured at each of said first end of said doors;

a means for releasing said second end of each of said doors from said hull section;

at least two inflatable members, each of said inflatable members secured within each of said cavities, each of said inflatable members expansive to position said door to an initial angle from a longitudinal axis of said hull section upon actuation of said releasing means and adapted to assume a generally spherical configuration outside the contour of the undersea vehicle upon inflation; and means within said hull section for inflating each of said inflatable members with a gas in response to a signal;

wherein the position of said door at the initial angle allows hydrodynamic forces resulting from a movement of the undersea vehicle to fully deploy said door to an angle to decelerate the undersea vehicle by a counter-acting hydrodynamic force and to provide a pathway for each of said inflatable members to inflate from said cavities thereby rendering the undersea vehicle buoyant for sea surface recovery.

2. The assembly in accordance with claim 1, said assembly further comprising a compression dampener mechanically positioned between said hinge and said hull section, said dampener capable of controlling the movement of said hinge and said door during deployment of said door.

3. The assembly in accordance with claim 2, wherein said hinge further comprises a slot and said compression dampener further comprises a piston rod movable within said slot wherein movement within said slot allows said piston rod to travel to an end of said slot while said door opens to the initial angle thereby further controlling the movement of said hinge and said door during deployment of said door.

4. The assembly in accordance with claim 3, said assembly further comprising at least two webs, each of said webs detachably secured to said hull section between each of said inflatable members and an exterior of said hull section wherein said web flexes from said hull section to contain said inflatable member when said inflatable member positions said door to the initial angle and wherein said web detaches from said hull section in response to inflation of said inflatable member.

5. The assembly in accordance with claim 4, wherein said releasing means comprises a pneumatic latching mechanism.

6. The assembly in accordance with claim 5, said assembly further comprising a first solenoid valve fluidly connected to said inflating means and said latching mechanism, said first solenoid valve set to actuate upon a predetermined depth pressure thereby allowing the gas from said inflating means to activate a releasing action of said latching mechanism.

7. The assembly in accordance with claim 6, said assembly further comprising a gas bleed line fluidly connected to said latching mechanism and to the exterior surface of said hull section, said bleed line sized to depressurize said latching mechanism thereby allowing said latching mechanism to retract to a closed position subsequent to the releasing action of said latching mechanism.

8. The assembly in accordance with claim 7, said assembly further comprising a second solenoid valve fluidly connected to said inflating means and each of said inflatable members, said second solenoid valve set to allow the gas from said inflating means to each of said inflatable members based upon a deceleration rate of the undersea vehicle.

9. The assembly in accordance with claim 8, said assembly further comprising a flow control valve fluidly connected between said second solenoid valve and said inflatable members, said flow control valve including a variable orifice controlled by a piston calibrated to balance depth pressures to the control of the gas to said inflatable members.

10. The assembly in accordance with claim 9, said assembly further comprising at least one relief valve fluidly connected to said flow control valve and sized to limit inflation pressure of each of said flotation bags.

11. The assembly in accordance with claim 10, said assembly further comprising a manually operated normally closed bleed valve for each of said inflatable members wherein each said bleed valve is capable of deflating each of said inflatable members to within said cavities for reuse of said assembly.

12. The assembly in accordance with claim 11, wherein the initial angle is 17 degrees.

13. A deceleration and positive buoyancy assembly for use with an undersea vehicle, said assembly comprising:

a hull section generally conforming in shape to a contour of the undersea vehicle upon which said hull section is positioned;

at least two cavities formed within said hull section, each of said cavities formed opposite to each other along a perimeter of said hull section;

a door mechanically secured to said hull section at each of said cavities, said door having a first and second end, said second end more proximate to a end of said hull section closer to a projecting end of the undersea vehicle than said first end of said door with each of said doors positioned to encompass said cavity coincident to an exterior surface of said hull section;

a hinge secured at each of said first end of said doors;

a pneumatic latching mechanism releasably connected to said second end of said doors from said hull section;

at least two inflatable members, each of said inflatable members secured within each of said cavities and capable of expanding to position said door to an initial angle from a longitudinal axis of said hull section upon the releasing action of said second end from said latching mechanism and;

means within said hull section for inflating each of said inflatable members;

a first solenoid valve fluidly connected to said inflating means and said latching mechanism, said first solenoid valve set to actuate upon a predetermined depth pressure thereby allowing gas from said inflating means to activate the releasing action of said latching mechanism;

a second solenoid valve fluidly connected from said inflating means and each of said inflatable members, said second solenoid valve controllable to allow the gas from said inflating means to said inflatable members based upon a deceleration rate of the undersea vehicle;

a flow control valve fluidly connected between said second solenoid valve and said inflatable members, said flow control valve including a variable orifice controlled by a piston calibrated to balance depth pressures to the control of the gas to said inflatable members;

wherein the position of said door at the initial angle allows hydrodynamic forces resulting from a movement of the undersea vehicle to fully deploy said door to an angle to decelerate the undersea vehicle by a counter-acting hydrodynamic force and to provide a pathway for each of said inflatable members to inflate; and wherein each of said inflatable members is capable of assuming a generally spherical configuration outside the contour of the undersea vehicle upon inflation thereby rendering the undersea vehicle buoyant for sea surface recovery.

14. The assembly in accordance with claim 13, said assembly further comprising at least one relief valve fluidly connected to said flow control valve and sized to limit inflation pressure of each of said flotation bags.

15. The assembly in accordance with claim 14, said assembly further comprising a compression dampener mechanically positioned between said hinge and said hull section, said dampener capable of controlling the movement of said hinge and said door during deployment of said door.

16. The assembly in accordance with claim 15, said assembly further comprising at least two webs, each of said webs detachably secured to said hull section between each of said inflatable members and an exterior of said hull section wherein each of said web flexes from said hull section to contain each of said inflatable members when said inflatable member positions said door to the initial angle and wherein said web detaches from said hull section in response to inflation of said inflatable member.

17. The assembly in accordance with claim 16 wherein said hinge further comprises a slot and said compression dampener further comprises a piston rod movable within said slot wherein movement within said slot allows said piston rod to travel to an end of said slot while said door opens to the initial angle thereby further controlling the movement of said hinge and said door during deployment of said door.

18. The assembly in accordance with claim 17, said assembly further comprising a gas bleed line fluidly connected to said latching mechanism and to the exterior surface of said hull section, said bleed line sized to depressurize said latching mechanism thereby allowing said latching mechanism to retract to a closed position subsequent to the releasing action of said latching mechanism.

19. The assembly in accordance with claim 18, said assembly further comprising a manually operated normally closed bleed valve for each of said inflatable members wherein each said bleed valve is capable of deflating each of said inflatable members to within said cavities for reuse of said assembly.

* * * * *